US006573666B1

(12) United States Patent
Killat

(10) Patent No.: US 6,573,666 B1
(45) Date of Patent: Jun. 3, 2003

(54) DIGITAL REGULATION OF FLUORESCENT LAMPS

(75) Inventor: Dirk Killat, Kircheim (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 10 days.

(21) Appl. No.: 10/042,572

(22) Filed: Jan. 9, 2002

(30) Foreign Application Priority Data

Jan. 3, 2002 (EP) ..... 02368001

(51) Int. Cl.[7] ..... G05F 1/00

(52) U.S. Cl. ..... 315/291; 315/307; 315/308; 315/362; 315/224; 315/DIG. 4; 341/143; 341/110

(58) Field of Search ..... 315/291, 307, 315/308, 362, 194, 224, 293, DIG. 4; 341/110, 126, 141, 143, 144, 155

(56) References Cited

U.S. PATENT DOCUMENTS

| | | | | |
|---|---|---|---|---|
| 5,204,587 A | | 4/1993 | Mortimer et al. | 315/308 |
| 5,806,055 A | | 9/1998 | Zinda, Jr. | 706/45 |
| 6,043,611 A | | 3/2000 | Gradzki et al. | 315/194 |
| 6,150,772 A | | 11/2000 | Crane | 315/291 |
| 6,188,177 B1 | * | 2/2001 | Adamson et al. | 315/149 |
| 6,198,417 B1 | | 3/2001 | Paul | 341/143 |
| 6,307,765 B1 | | 10/2001 | Choi | 363/134 |
| 6,337,544 B1 | * | 1/2002 | Wang et al. | 315/291 |

FOREIGN PATENT DOCUMENTS

WO WO 01/45473 A1 6/2001

* cited by examiner

*Primary Examiner*—Haissa Philogene
(74) *Attorney, Agent, or Firm*—George O. Saile; Stephen B Ackerman; Douglas R. Schnabel

(57) ABSTRACT

A method to control the illumination intensity of a gas discharge lamp is achieved. The method comprises, first, converting an analog lamp illumination signal into a digital lamp illumination signal. The analog lamp illumination signal is a function of the illumination intensity of a gas discharge lamp. Second, digital target signal is subtracted from the digital lamp illumination signal to create a digital error signal. Third, a digital frequency set point is adjusted from a current value to a new value based on the digital error signal. The digital frequency set point is a high resolution digital value. Fourth, the current value and the new value are averaged by a digital delta sigma modulator to create a smoothed frequency set point. The smoothed frequency set point is a medium resolution value. Finally, an oscillating voltage signal is generated with a drive frequency based on the smoothed frequency set point. The drive frequency determines the illumination intensity of the gas discharge lamp.

33 Claims, 2 Drawing Sheets

DIGITAL REGULATION OF FLUORESCENT LAMPS

BACKGROUND OF THE INVENTION (1) Field of the Invention

The invention relates to a method to control a gas discharge lamp, and more particularly, to a method and a circuit to digitally control the illumination intensity of a gas discharge lamp.

(2) Description of the Prior Art

Gas discharge lamps are used in a wide variety of applications. A typical example of a gas discharge lamp is a fluorescent lamp. In a gas discharge lamp, a large voltage is used to ionize the gas inside the lamp tube. Once an ionization arc has been established, continued application of electrical power causes the lamp to provide light.

It is often difficult to dim the illumination intensity of a gas discharge lamp because it is difficult to maintain a perceptibly constant arc at low illumination levels. Interruptions in the current arc cause the lamp to flicker.

Prior art solutions to controlling, and more particularly, providing dimming control of gas discharge lamps, typically involve rather complex analog circuits. Typically, an analog voltage controlled oscillator (VCO) is used to create a variable lamp driver frequency. As the driver frequency is reduced, the lamp dims. In this scheme, the VCO may drive a pulse width modulated (PWM) output to the lamp. When such analog solutions are up integrated onto an IC, they suffer from a high I/O pin count, poor noise immunity, and large silicon area. Finally, the VCO approach circuit is adversely affected by the presence of other oscillators on the integrated circuit device.

Several prior art inventions describe methods and apparatus to control fluorescent lamps. U.S. Pat. No. 6,150,772 to Crane describes a control circuit for a gas discharge lamp. A microcontroller is used to set analog voltage, current, and pulse width modulated (PWM) outputs based on a memory lookup table. U.S. Pat. No. 6,043,611 to Gradzki et al teaches a compact fluorescent lamp capable of dimming. A triac dimmer with a RC snubber is used to control illumination intensity. U.S. Pat. No. 5,204,587 to Mortimer et al discloses a fluorescent lamp control circuit that reduces the external power level to the lamp to achieve dimming. U.S. Pat. No. 6,198,417 to Paul teaches a pipelined, oversampling A/D converter using a delta sigma ($\Delta\Sigma$) modulator.

SUMMARY OF THE INVENTION

A principal object of the present invention is to provide an effective and very manufacturable method and circuit for controlling a gas discharge lamp.

A further object of the present invention is to provide a method and a circuit for controlling the illumination intensity of a gas discharge lamp, such as a fluorescent lamp, by modulating the oscillation frequency.

A still further object of the present invention is to provide a method and a circuit for controlling the illumination intensity of a gas discharge lamp while eliminating flicker by smoothing frequency steps using a digital delta sigma ($\Delta\Sigma$) modulator.

In accordance with the objects of this invention, a method to control the illumination intensity of a gas discharge lamp is achieved. The method comprises, first, converting an analog lamp illumination signal into a digital lamp illumination signal. The analog lamp illumination signal is a function of the illumination intensity of a gas discharge lamp. Second, digital target signal is subtracted from the digital lamp illumination signal to create a digital error signal. Third, a digital frequency set point is adjusted from a current value to a new value based on the digital error signal. The digital frequency set point is a high resolution digital value. Fourth, the current value and the new value are averaged by a digital delta sigma modulator to create a smoothed frequency set point. The smoothed frequency set point is a medium resolution value. Finally, an oscillating voltage signal is generated with a drive frequency based on the smoothed frequency set point. The drive frequency determines the illumination intensity of the gas discharge lamp.

Also in accordance with the objects of this invention, a circuit for controlling the illumination intensity of a gas discharge lamp is achieved. The circuit comprises, first, an analog-to-digital converter to convert an analog lamp illumination signal into a digital lamp illumination signal. The analog lamp illumination signal is a function of the illumination intensity of a gas discharge lamp. Second, a means of subtracting a digital target illumination signal from the digital lamp illumination signal to create a digital error signal is included. Third, a digital regulator circuit is used for adjusting a digital frequency set point from a current value to a new value based on the digital error signal. The digital frequency set point is a high resolution digital value. Fourth, a digital delta sigma modulator is used for averaging the current value and the new value to create a smoothed frequency set point. The smoothed frequency set point is a medium resolution value. Finally, a digital controlled oscillator is used for generating an oscillating voltage signal with a drive frequency based on the smoothed frequency set point. The drive frequency determines the illumination intensity of the gas discharge lamp.

BRIEF DESCRIPTION OF THE DRAWINGS

In the accompanying drawings forming a material part of this description, there is shown.

DESCRIPTION OF THE PREFERRED EMBODIMENTS

The preferred embodiment illustrates a method and a circuit of the present invention. A unique method to control the illuminating intensity of a gas discharge lamp using a digital signal processing technique is disclosed. Further, a digital circuit for implementing the method is described. It should be clear to those experienced in the art that the present invention can be applied and extended without deviating from the scope of the present invention.

Figure 1:
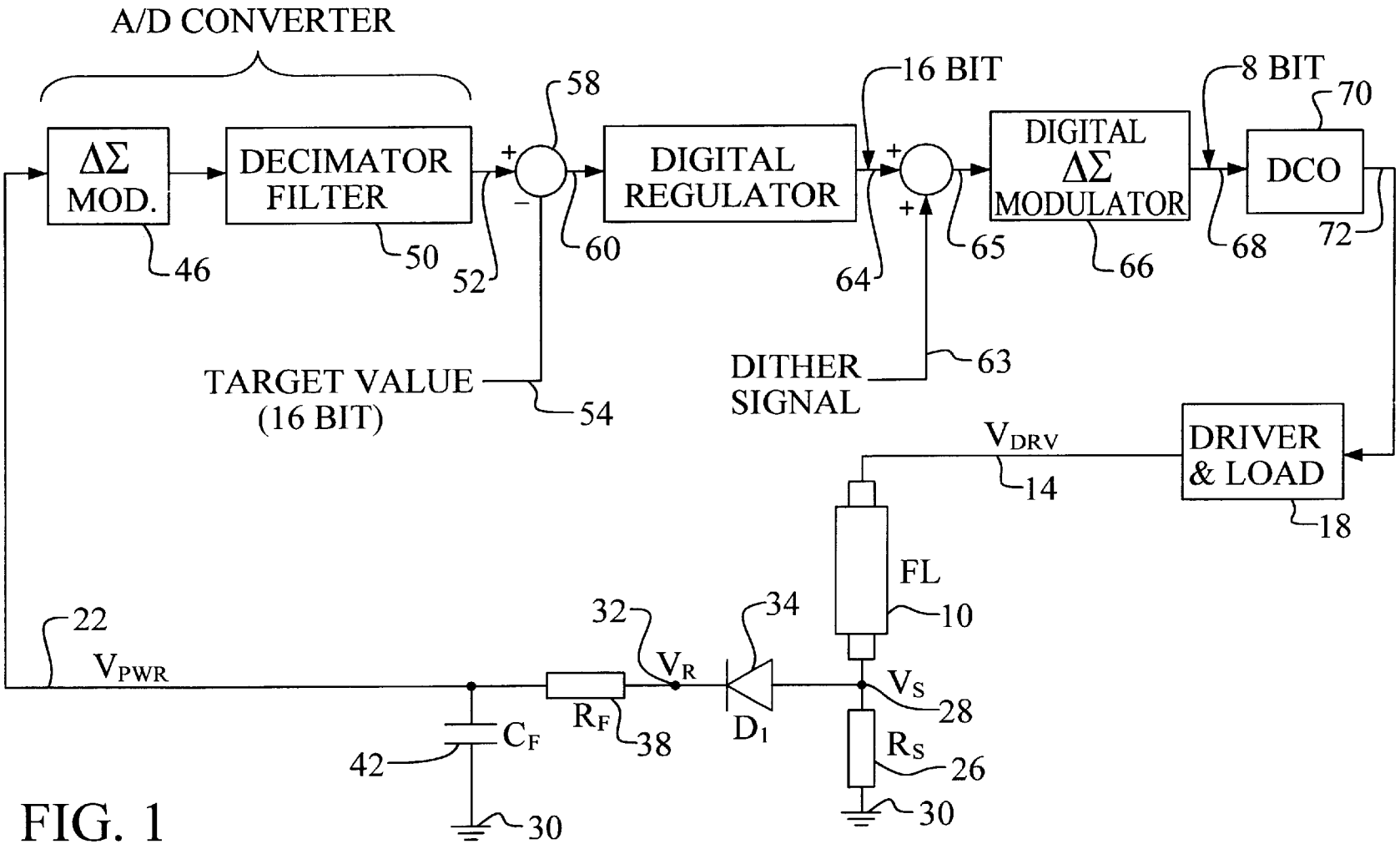
FIG. 1 illustrates the preferred embodiment of the present invention circuit for controlling a gas discharge lamp.

Referring now to FIG. 1, the preferred embodiment of the present invention is illustrated. Several important features of the present invention are shown. The new circuit to control the illumination intensity of a gas discharge lamp is illustrated. The gas discharge lamp FL 10, may comprise, for example, a fluorescent lamp.

As a key feature, an analog-to-digital (A/D) converter 46 and 50 is used to convert the analog lamp illumination signal, $V_{PWR}$ 22, to a digital lamp illumination signal. The signal $V_{PWR}$ 22 is proportional to, or a function of, the lamp power. The up front conversion of the analog lamp illumination signal, $V_{PWR}$ 22, into a digital target illumination signal 52 is important because this enables the remaining feedback control processing to be performed in the digital domain. This greatly reduces the impact of signal noise on the circuit. It is preferred that the A/D converter, and particularly the decimator 50, filters out significant noise components on the $V_{PWR}$ 22 signal. This decimator 50 filters out any remaining lamp frequency (ripple) that has not been filtered by the discrete low pass comprising $R_F$ 38 and $C_F$ 42.

There are several methods that may be used to derive the $V_{PWR}$ 22 signal from the lamp circuitry, the lamp ballast, or the power driver 18. All that is needed is a $V_{PWR}$ 22 signal that is proportional to, or that is a function of, the lamp power where the $V_{PWR}$ 22 signal is a positive value between VSS and VDD. FIG. 1 shows one method wherein $V_{PWR}$ 22 is proportional to the rectified and smoothed lamp current. In this embodiment, a sense resistor, $R_S$ 26, is used to sample the current flowing through the lamp FL 10 and generate $V_S$ 28. A diode, $D_1$ 34, rectifies the alternating current flow to provide a positive power signal, $V_R$ 32. The rectified signal is then passed through a low pass filter, such as the one formed by $R_F$ and $C_F$, to create the analog lamp power signal, $V_{PWR}$ 22. While not shown in this embodiment, another method of deriving $V_{PWR}$ 22 is to measure the current that is flowing through the source of the low side driver of the driver & load circuit 18. In this case, $D_1$ 34 can be omitted. The low pass comprising $R_F$ and $C_F$ is then coupled to a shunt resistance in series with the low side driver FET of the driver circuit 18.

As an important feature, the A/D converter 46 and 50 preferably comprises a delta sigma (ΔΣ) modulator 46 and a digital decimator filter 50. The ΔΣ modulator 46 creates a pulse train of positive and negative values that correspond to the sampled input. This sampling is performed at a high frequency to insure no loss of signal. Preferably, the digital delta sigma modulator 46 uses a sampling frequency of between about 500 KHz and 10 MHz. The digital decimator filter circuit 50 comprises a low pass filter and a down sampler. The combination of the low pass filter and the down sampler removes any high frequency noise components and generates a stream of data bytes (typically 8 bit values) or data words (typically 16 bit values) comprising a digital target illumination signal 52. The actual bit-width of these signals depends upon the down-sampling ratio of the circuit.

As an important feature, a digital target value 54 is subtracted from the digital lamp illumination signal 52 to create a digital error signal 60. This digital target signal 54 may be a high resolution (16 bit) or medium resolution (8 bit) signal that corresponds to the requested illumination intensity for the lamp. The digital regulator circuit 62 uses the digital error signal 60 value to adjust a digital frequency set point 64. The digital regulator circuit 62 may comprise a counting circuit that is up-counted or down-counted based on the value of the digital error signal 60. If an up/down counting method is used, then this establishes a two-point regulator. Alternatively, a P1 regulator may be used for dimming purposes. The digital frequency set point 64 generated by the digital regulator 62 is a high resolution digital value of between 14 and 18 bits and, more preferably of 16 bits. The digital frequency set point 64 must have this degree of resolution to prevent visible dimming steps as the target value 54 is adjusted and to prevent flickering. The digital frequency set point 64 controls the drive frequency to the lamp FL 10.

As another important, though optional, feature, a dither signal 63 is added to the digital frequency set point 64. This dither signal 63 comprises a 'white noise' signal that purposely includes a broad band of signal frequencies. The purpose of adding the dither signal 63 to the digital frequency set point 64 prior to the digital delta sigma modulator 66 is to avoid periodic output signals, or tones, at the output of the digital delta sigma modulator 66.

In a particularly important feature, the high resolution, the digital delta sigma modulator input 65, is averaged in the digital delta sigma (ΔΣ) modulator 66 to create a smoothed frequency set point 68. This averaging is necessary to prevent harmonic frequencies, potentially introduced by the frequency stepping of the digital controlled oscillator (DCO) 70, from generating harmonic frequencies and flicker. The smoothed frequency set point 68 is a medium resolution signal of between about 8 and 10 bits and, more preferably, of 8 bits, that is the command set point for the DCO 70.

Figure 2:
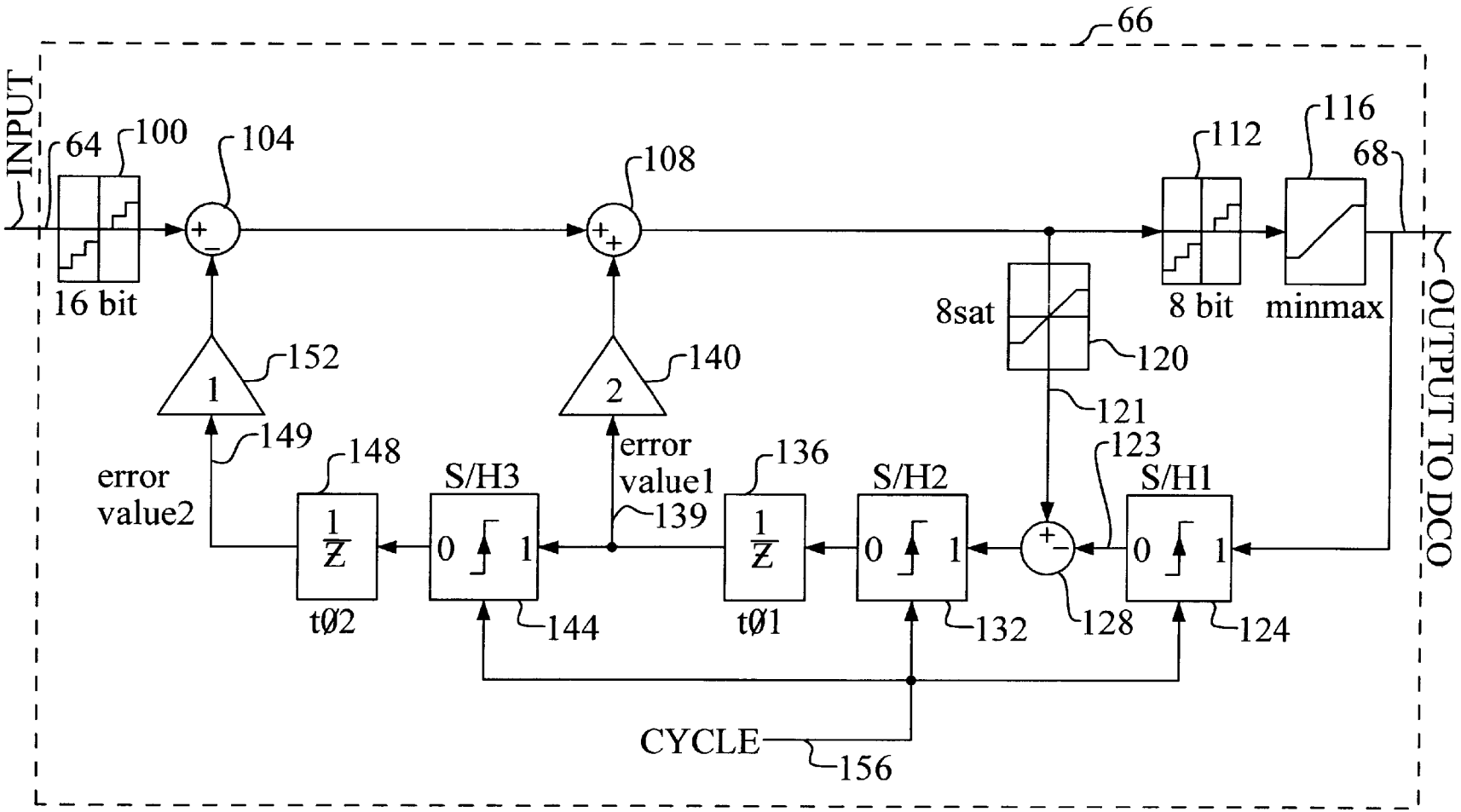
FIG. 2 illustrates a preferred embodiment of the digital delta sigma ($\Delta\Sigma$) modulator used for smoothing the frequency set point value.

Referring now to FIG. 2, the preferred embodiment of the digital delta sigma modulator 66 of the present invention is shown. While the particular components of the digital delta sigma modulator may vary, an important feature is that the circuit comprise a second order modulator having error feedback. Further, the circuit should comprise a high resolution input, of between 14 and 18 bits, and a lower resolution output, of between 8 and 10 bits.

In the circuit of FIG. 2, the modulator 66 has input 64 and output 68. A first sample and hold S/H1 124 samples the output value 68. A second sample and hold S/H2 and first delay t01 136 form a first clocked delay element. A third sample and hold S/H3 and second delay t02 136 form a second clocked delay element. The limiter blocks 116 and 120 prevent overflows. The quantizer 112 causes a truncation of the least significant bits (LSB) of the modulator output. The difference point 128 evaluates the difference between the non-truncated modulator output 121 and the truncated modulator output 123. With each clock cycle 156, an error value 2 149, weighted by the gain 152, is fed back to the difference point 104. In addition, an error value 1 139, weighted by the gain 140, is fed back to the sum point 108.

Most importantly, the average output value 68 is equal to the most significant bits (MSB) of the input value 64. However, the frequency spectrum of the stream of output values has no low frequency components. This eliminates the source of flicker in the lamp. Note that the schematic of FIG. 2 contains some elements that are needed for simulation. For example, the 16 bit generator 100 is for simulation purposes only.

Referring again to FIG. 1, the higher frequency set point input 64 preferably comprises 8 data bits left of the decimal point and 8 data bits right of the decimal point. The 8-bit output of the modulator to the DCO 70 preferably comprises only 8 bits left of the decimal (MSB). The delta sigma modulator generates a stream of these 8 bit values having an average value equal to the 16 bit input value (8 bits to each side of the decimal). However, the spectral content of the 8 bit stream is very broad, or nearly white, in nature. Therefore, no visible flickering of the driven lamp will be produced.

The DCO 70 creates a variable frequency digital output 72 that is preferably a pulse width modulated (PWM) signal. The DCO output 72 is a moderate resolution signal that controls the power driver 18 circuit. The driver 18 uses the variable frequency signal 72 from the DCO 70 to create the high voltage and current signal, $V_{DRV}$ 14. The $V_{DRV}$ 14 frequency varies from about 40 KHz to about 120 KHz in frequency as directed by the digital controller.

The present invention provides a unique and advantageous method and circuit for controlling a gas discharge lamp. The digital control technique reduces the effect of signal noise while enabling a smaller circuit design on an IC. The unique signal processing, especially the delta sigma modulator averaging of the digital regulator output, improves dimming performance by eliminating flicker.

The advantages of the present invention may now be summarized. First, an effective and very manufacturable method and circuit for controlling a gas discharge lamp is achieved, Second, a method for controlling the illumination intensity of a gas discharge lamp, such as a fluorescent lamp, by modulating the oscillation frequency is achieved. The method eliminates flicker by smoothing frequency steps using a digital delta sigma ($\Delta\Sigma$) modulator. Finally, an effective circuit implementation for this lamp control method is achieved.

While the invention has been particularly shown and described with reference to the preferred embodiments thereof, it will be understood by those skilled in the art that various changes in form and details may be made without departing from the spirit and scope of the invention.

What is claimed is:

1. A method to control the illumination intensity of a gas discharge lamp comprising:

converting an analog lamp illumination signal into a digital lamp illumination signal wherein said analog lamp illumination signal is a function of the illumination intensity of a gas discharge lamp;

subtracting a digital target signal from said digital lamp illumination signal to create a digital error signal;

adjusting a digital frequency set point from a current value to a new value based on said digital error signal wherein said digital frequency set point is a high resolution digital value;

averaging said current value and said new value by a digital delta sigma modulator to create smoothed frequency set point wherein said smoothed frequency set point is a medium resolution value; and generating an oscillating voltage signal with a drive frequency based on said smoothed frequency set point wherein said drive frequency determines said illumination intensity of said gas discharge lamp.

2. The method according to claim 1 further comprising providing a positive illumination signal having a value between VSS and VDD.

3. The method according to claim 2 wherein said step of providing a positive illumination signal further comprises:

rectifying said analog lamp illumination signal; and filtering said analog lamp illumination signal.

4. The method according to claim 1 wherein said step of converting an analog lamp illumination signal into a digital lamp illumination signal comprises signal processing using an analog-to-digital converter.

5. The method according to claim 4 wherein said analog-to-digital converter is a delta sigma modulator.

6. The method according to claim 5 further comprising digitally filtering lamp frequency ripple from said digital lamp illumination signal.

7. The method according to claim 5 wherein said digital delta sigma modulator uses a sampling frequency of between about 500 KHz and 10 MHz.

8. The method according to claim 1 wherein said step adjusting a digital frequency set point from a current value to a new value based on said digital error signal comprises counting based on a digital clock.

9. The method according to claim 1 wherein said high resolution comprises between 14 and 18 bits and said medium resolution comprises between 8 and 10 bits.

10. The method according to claim 1 further comprising adding a white noise dither signal to said digital frequency set point new value prior to said step of averaging.

11. The method according to claim 1 wherein said digital delta sigma modulator comprises a second order modulator with error feedback.

12. The method according to claim 1 wherein said gas discharge lamp comprises a fluorescent lamp.

13. A method to control the illumination intensity of a gas discharge lamp comprising:

converting an analog lamp illumination signal into a digital lamp illumination signal wherein said analog lamp illumination signal is a function of the illumination intensity of a gas discharge lamp;

subtracting a digital target signal from said digital lamp illumination signal to create a digital error signal;

adjusting a digital frequency set point from a current value to a new value based on said digital error signal wherein said digital frequency set point is a high resolution digital value;

adding a white noise dither signal to said digital frequency set point new value;

thereafter averaging said current value and said new value by a digital delta sigma modulator to create a smoothed frequency set point wherein said smoothed frequency set point is a medium resolution value and wherein said digital delta sigma modulator comprises a second order modulator with error feedback; and generating an oscillating voltage signal with a drive frequency based on said smoothed frequency set point wherein said drive frequency determines said illumination intensity of said gas discharge lamp.

14. The method according to claim 13 further comprising providing a positive illumination signal having a value between VSS and VDD.

15. The method according to claim 14 wherein said step of providing a positive illumination signal further comprises:

rectifying said analog lamp illumination signal; and filtering said analog lamp illumination signal.

16. The method according to claim 13 wherein said step of converting an analog lamp illumination signal into a digital lamp illumination signal comprises signal processing using an analog-to-digital converter.

17. The method according to claim 16 wherein said analog-to-digital converter is a delta sigma modulator.

18. The method according to claim 17 further comprising digitally filtering lamp frequency ripple from said digital lamp illumination signal.

19. The method according to claim 17 wherein said digital delta sigma modulator uses a sampling frequency of between about 500 KHz and 10 MHz.

20. The method according to claim 13 wherein said step adjusting a digital frequency set point from a current value to a new value based on said digital error signal comprises counting based on a digital clock.

21. The method according to claim 13 wherein said high resolution comprises between 14 and 18 bits and said medium resolution comprises between 8 and 10 bits.

22. The method according to claim 13 wherein said gas discharge lamp comprises a fluorescent lamp.

23. A circuit for controlling the illumination intensity of a gas discharge lamp comprising:

an analog-to-digital converter to convert an analog lamp illumination signal into a digital lamp illumination signal wherein said analog lamp illumination signal is a function of the illumination intensity of a gas discharge lamp;

a means of subtracting a digital target illumination signal from said digital lamp illumination signal to create a digital error signal;

a digital regulator circuit for adjusting a digital frequency set point from a current value to a new value based on said digital error signal wherein said digital frequency set point is a high resolution digital value;

a digital delta sigma modulator for averaging said current value and said new value to create a smoothed frequency set point wherein said smoothed frequency set point is a medium resolution value; and a digital controlled oscillator for generating an oscillating voltage signal with a drive frequency based on said smoothed frequency set point wherein said drive frequency determines said illumination intensity of said gas discharge lamp.

24. The circuit according to claim 23 further comprising a means to provide a positive illumination signal having a value between VSS and VDD.

25. The circuit according to claim 24 wherein said means of providing a positive illumination signal further comprises:

a diode; and a low pass filter.

26. The circuit according to claim 23 wherein said analog-to-digital converter comprises a delta sigma modulator and a decimator filter.

27. The circuit according to claim 26 wherein said decimator filter eliminates lamp frequency ripple.

28. The circuit according to claim 23 wherein said digital regulator circuit comprises a counter based on a digital clock.

29. The circuit according to claim 23 wherein said digital delta sigma modulator uses a sampling frequency of between about 500 KHz and 10 MHz.

30. The circuit according to claim 23 wherein said high resolution comprises between 14 and 18 bits and said medium resolution comprises between 8 and 10 bits.

31. The circuit according to claim 23 further comprising a means of adding a white noise dither signal to said digital frequency set point new value.

32. The circuit according to claim 23 wherein said digital delta sigma modulator comprises a second order modulator with error feedback.

33. The circuit according to claim 23 wherein said gas discharge lamp comprises a fluorescent lamp.

* * * * *

UNITED STATES PATENT AND TRADEMARK OFFICE

CERTIFICATE OF CORRECTION

PATENT NO. : 6,573,666 B1
DATED : June 3, 2003
INVENTOR(S) : Dirk Killat

It is certified that error appears in the above-identified patent and that said Letters Patent is hereby corrected as shown below:

Title page,
Item [75], delete "Dirk Killat, Kircheim (DE)", and replace with
-- Dirk Killat, Kirchheim (DE) --.

Signed and Sealed this

Sixteenth Day of September, 2003

JAMES E. ROGAN
*Director of the United States Patent and Trademark Office*